US008668476B1

(12) United States Patent
Scott

(10) Patent No.: US 8,668,476 B1
(45) Date of Patent: Mar. 11, 2014

(54) PUMP EXPANSION VESSEL

(71) Applicant: Alexander Robin Walter Scott, Okotoks (CA)

(72) Inventor: Alexander Robin Walter Scott, Okotoks (CA)

(73) Assignee: Coolit Systems Inc., Calgary (CA)

( * ) Notice: Subject to any disclaimer, the term of this patent is extended or adjusted under 35 U.S.C. 154(b) by 0 days.

(21) Appl. No.: 13/776,673

(22) Filed: Feb. 25, 2013

Related U.S. Application Data

(63) Continuation of application No. 11/745,932, filed on May 8, 2007, now Pat. No. 8,382,456.

(60) Provisional application No. 60/909,032, filed on Mar. 30, 2007.

(51) Int. Cl.
*F01D 25/28* (2006.01)
*H05K 7/20* (2006.01)

(52) U.S. Cl.
USPC ..... 417/423.14; 361/679.53

(58) Field of Classification Search
USPC ..... 417/313, 423.1, 423.14, 540, 543; 138/30; 361/679.53, 698, 699–703; 378/130, 141, 199, 200, 201, 202
See application file for complete search history.

(56) References Cited

U.S. PATENT DOCUMENTS 4,307,204 A * 12/1981 Vidal ..... 521/140
4,500,487 A 2/1985 Christie et al.
4,651,781 A 3/1987 Kandelman
4,823,844 A 4/1989 Bartholomew
4,950,133 A 8/1990 Sargent
5,325,944 A 7/1994 Livingston, Sr.
5,535,818 A 7/1996 Fujisaki et al.
5,709,248 A 1/1998 Goloff
5,714,696 A 2/1998 Yeamans
5,967,623 A * 10/1999 Agnew ..... 303/87
6,074,092 A * 6/2000 Andrews ..... 378/200
6,076,557 A 6/2000 Carney
6,543,485 B2 4/2003 Henry et al.
6,679,315 B2 1/2004 Cosley et al.
6,900,990 B2 5/2005 Tomioka
6,971,243 B2 12/2005 Scott
7,108,016 B2 9/2006 Moskalik et al.
7,121,304 B2 10/2006 Gray et al.
7,174,738 B2 2/2007 Scott et al.
2006/0051222 A1* 3/2006 Lee et al. ..... 417/423.14
2006/0204389 A1 9/2006 Weber et al.

* cited by examiner

*Primary Examiner* — Bryan Lettman
(74) *Attorney, Agent, or Firm* — Ganz Law, PC

(57) ABSTRACT

A housing can have a cap, a base member and a mid-portion positioned between and removably coupled with the cap and the base member. The cap and the mid-portion can define a reservoir therebetween and the cap can define a recessed inner wall in fluid communication with the reservoir. The mid-portion can define a recessed impeller chamber configured to receive a pump impeller. The mid-portion can further define a retainer positioned between the impeller chamber and the inner chamber. A resiliently compressible member can be positioned within the inner chamber and configured to resiliently compress in response to a volumetric expansion of the liquid coolant. The retainer can contact the resiliently compressible member to prevent the resiliently compressible member from moving out of the reservoir or into a position blocking a liquid coolant flow through a port. The mid-portion can define a housing wall forming the retainer.

22 Claims, 2 Drawing Sheets

PUMP EXPANSION VESSEL

CROSS-REFERENCE TO RELATED APPLICATIONS

This application is a continuation of U.S. patent application Ser. No. 11/745,932, filed May 8, 2007, set to issue as U.S. Pat. No. 8,382,456, which claims benefit of and priority to U.S. Provisional Patent Application No. 60/909,032, filed Mar. 30, 3007, each of which earlier-filed application is hereby incorporated by reference in its entirety, as if recited in full, for all purposes.

BACKGROUND

In a closed pump circuit such as may be used in a hydraulic system or for coolant in a refrigeration system, an expansion/reservoir vessel is used to store the pump fluid. The expansion/reservoir vessel must be able to accommodate coolant volume spikes. Previously, volume spikes caused by coolant expansion were accommodated in various ways, as by use of diaphragms in the wall of the vessel, etc.

In a computer liquid-cooling system, for example, the coolant may have significant volume changes through temperature variances as the system operates. If a closed pump circuit is desired to be employed, such volume spikes must be accommodated. For example, volume spikes are sometimes accommodated by pressure release diaphragms or valves.

SUMMARY

In accordance with a broad aspect of the present inventive subject matter, there is provided a pump including: a housing defining therein an inner chamber of fixed volume; an inlet through the housing providing communication to the inner chamber; an outlet through the housing providing communication to the inner chamber; a pumping mechanism in the inner chamber; and a resiliently, compressible member accommodating a portion of the fixed volume of the inner chamber.

In accordance with another broad aspect of the present invention, there is provided a computer cooling system including: a liquid cooled heat exchanger and a pump circuit providing liquid coolant to the liquid cooled heat exchanger, the pump circuit including a pump with an inlet and an outlet, a pump discharge tubing extending between the pump outlet and the heat exchanger, and a pump return tubing extending between the heat exchanger and the pump inlet; and a pump coolant expansion/reservoir vessel including: a rigid wall structure; an inner chamber of fixed volume within the rigid wall structure; a port in the rigid wall for communication to a pump circuit; and a resiliently, compressible member in the inner chamber In accordance with another broad aspect of the present inventive subject matter, there is provided a computer cooling system including: a liquid cooled heat exchanger and a pump circuit providing liquid coolant to the liquid cooled heat exchanger, the pump circuit including a pump a housing defining therein an inner chamber of fixed volume; an inlet through the housing providing communication to the inner chamber; an outlet through the housing providing communication to the inner chamber; a pumping mechanism in the inner chamber; and a resiliently, compressible member accommodating a portion of the fixed volume of the inner chamber, a pump discharge tubing extending between the pump outlet and the heat exchanger, and a pump return tubing extending between the heat exchanger and the pump inlet.

It is to be understood that other aspects of the present inventive subject matter will become readily apparent to those skilled in the art from the following detailed description, wherein various embodiments of the inventive subject matter are shown and described by way of illustration. As will be realized, the inventive subject matter is capable for other and different embodiments and its several details are capable of modification in various other respects, all without departing from the spirit and scope of the present inventive subject matter. Accordingly the drawings and detailed description are to be regarded as illustrative in nature and not as restrictive.

BRIEF DESCRIPTION OF THE DRAWINGS

Referring to the drawings, several aspects of the present inventive subject matter are illustrated by way of example, and not by way of limitation, in detail in the figures, wherein.

DETAILED DESCRIPTION OF VARIOUS EMBODIMENTS

The detailed description set forth below in connection with the appended drawings is intended as a description of various embodiments of the present inventive subject matter and is not intended to represent the only embodiments contemplated by the inventor. The detailed description includes specific details for the purpose of providing a comprehensive understanding of the present inventive subject matter. However, it will be apparent to those skilled in the art that the present inventive subject matter may be practiced without these specific details.

Figure 1:
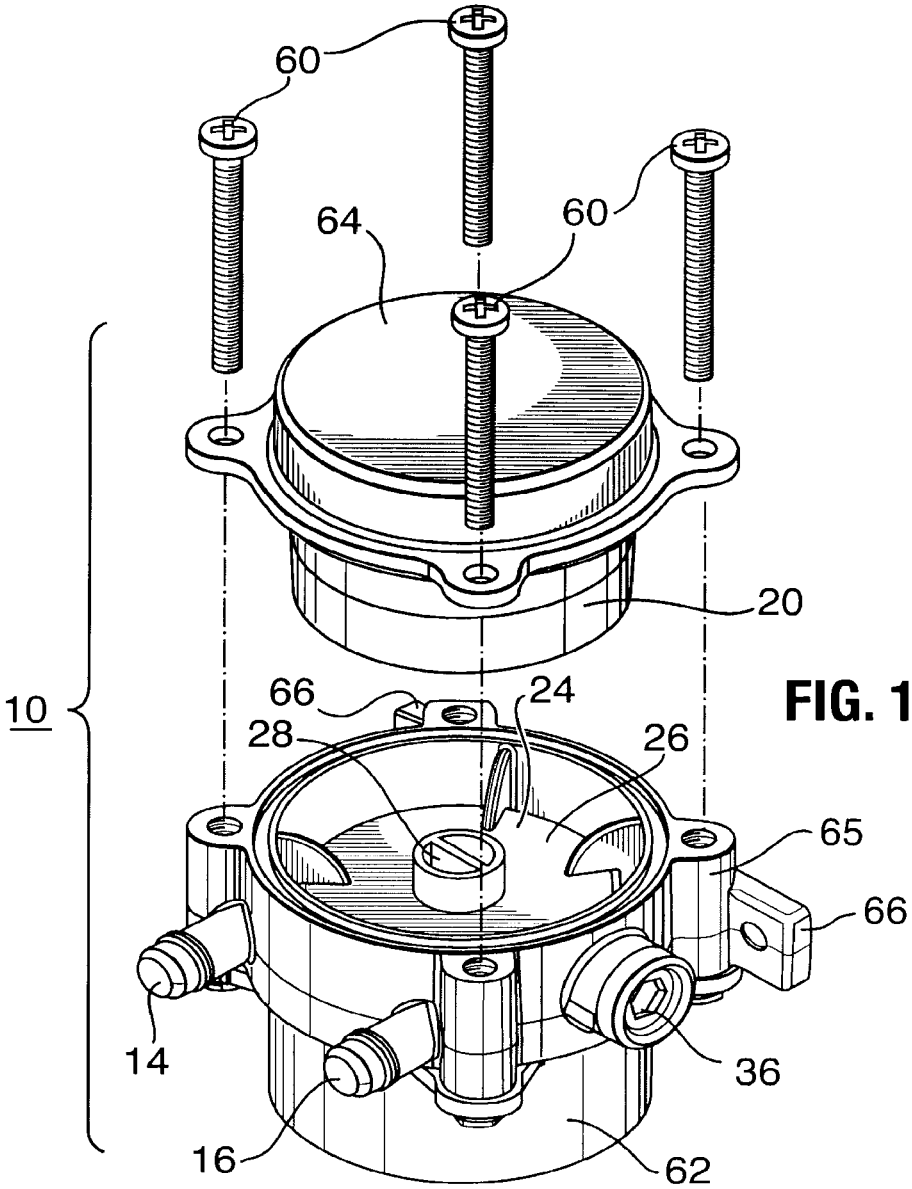
FIG. 1 is a top perspective view of a pump housing in exploded configuration.
Figure 2:
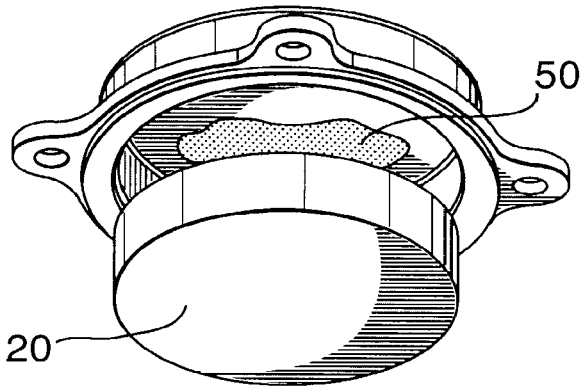
FIG. 2 is a bottom perspective view of a pump reservoir cap in exploded configuration.
Figure 3:
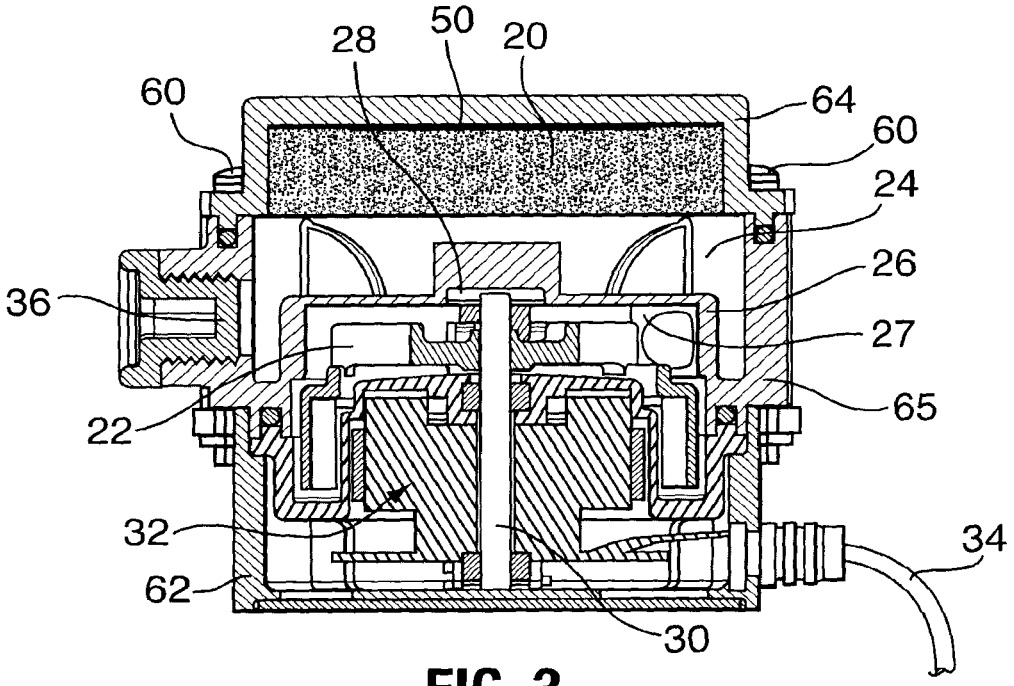
FIG. 3 is a sectional view through an assembled pump housing.

With reference to FIGS. 1 to 3, one embodiment of a pump 10 is shown. Although a description of one embodiment follows, it is to be understood that a pump and the various components thereof, according to the present inventive subject matter, may be of and include various forms, constructions, materials, sizes and configurations, as will be appreciated.

Pump 10 includes a housing 12 defining therein an inner chamber. Housing 12 may be formed of substantially rigid materials such that the volume of inner chamber is substantially fixed. Pump 10 further includes an inlet 14 and an outlet 16 extending through the housing providing fluid communication to the inner chamber. Pump 10 further includes a fluid pumping mechanism 18 and a resiliently compressible member 20 in the inner chamber to accommodate coolant expansion causing volume spikes in the pump circuit.

In the illustrated embodiment, the inner chamber includes at least an impeller chamber 27 in which pumping mechanism 18 is positioned and a reservoir 24, in fluid communication with the impeller chamber. In the illustrated embodiment, impeller chamber 27 and reservoir 24 are formed from the same pump housing and are separated by a wall 26 with a port 28 therethrough for fluid communication between impeller chamber 27 and reservoir 24. In the illustrated embodiment, inlet 14 opens to reservoir 24 and outlet 16 opens from impeller chamber 27. Reservoir 24 is positioned to accumulate air in the pump circuit and to store excess coolant.

Pumping mechanism 18, in the illustrated embodiment, includes an impeller 22 rotatable on a shaft 30. Impeller 22 is driven by a motor 32 such as an electrically driven motor as shown. An electrical supply line 34 is provided for powering the pump.

Pump 10 may include a fill port 36 including for example a port and closure, such as a correspondingly threaded port and plug, through which coolant may be introduced to the pump circuit.

Figure 4:
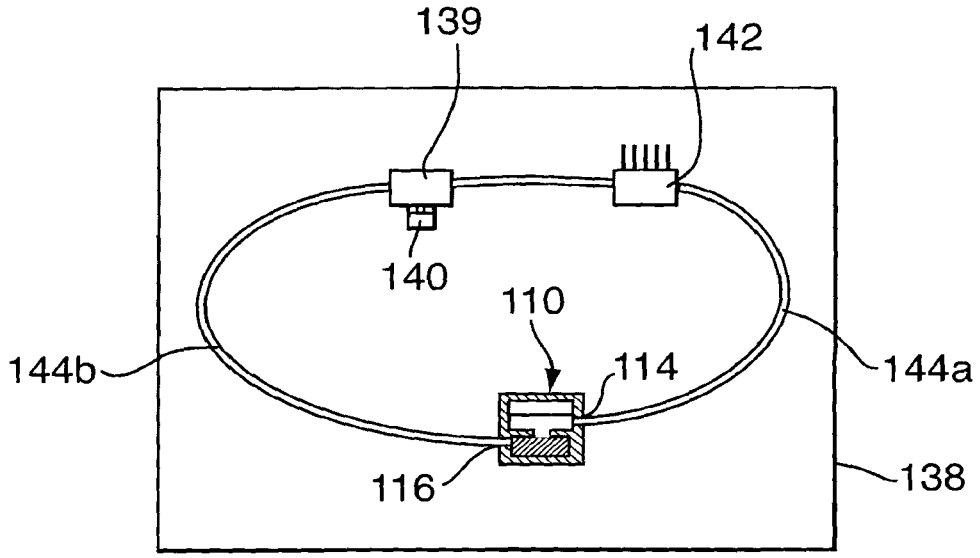
FIG. 4 is a schematic drawing of a pump circuit.

With reference to FIG. 4, a pump 110 such as, for example, that described in relation to FIGS. 1 to 3 may be used to move fluid through a pump circuit. For example, pump 110 may be used in a liquid cooled computer 138 to drive liquid coolant between heat exchangers such as a heat exchanger 139 in thermal communication with a heat source 140 and a heat sink 142. The pump's inlet 114 and outlet 116 may be formed as barbs, as shown in FIGS. 1 to 3, or in other ways for liquid tight connection of liquid tubing 144*a*, 144*b*. Pumping mechanism is capable of moving liquid coolant through the pump housing from the inlet to the outlet and through the discharge line 144*a* and the return line 144*b* such that the liquid coolant moves to accept thermal energy from a heat source 140 and unload that thermal energy at heat sink 142. Various examples of cooling systems, and in particular computer cooling systems and components thereof, are disclosed in U.S. Pat. Nos. 7,174,738, 6,971,243 and 6,725,682 of CoolIt Systems Inc., incorporated herein by reference.

In a computer cooling system, the coolant may be water, glycol, mixtures thereof or other liquids. Generally, the coolant is circulated to cool components such as chip sets, central processing units, etc. In some computer systems, the coolant may range in temperatures between −40° to and 85° C. in storage and between 0° and 90° C. in operation.

In the illustrated embodiment, the pump circuit is closed. To accommodate volume spikes caused by temperature changes and expansion of the coolant resiliently, compressible member 20 is provided in the inner chamber of the pump. In the illustrated embodiment, member 20 is positioned in reservoir 24. Member 20 may include, for example, one or more pieces of a closed cell sponge, also called closed cell foam. As will be appreciated, a closed cell sponge includes a material including a plurality of cells surrounded by material such that the cells are closed and the fluid within each cell is substantially trapped. The member accommodates space in the pump housing, but can be compressed by expansion of the coolant, as may be caused by an increase in coolant temperature, within the chamber. Compression of the sponge, increases the available volume for the coolant within the pump and the circuit to thereby avoid pressure spikes of the coolant within the circuit. Of course, during filling and refilling of the coolant, care may be taken to ensure that the sponge is not already fully compressed at ambient temperatures.

Member 20 may be formed from a polymer or other material that is resilient so that it can be compressed and substantially recover to its original volume repeatedly and is substantially resistant to break down in the environment of the pump circuit, with consideration to factors such as the temperatures, and prolonged contact with the liquid coolant. It is desirable that the material resist fluid crossover between the volumes of any closed cells of member 20 into the liquid coolant. In one embodiment, member 20 includes a synthetic rubber such as, for example, a polychloroprene such as is commonly known as Neoprene™ (Dupont Performance Elastomers).

Member 20 may be secured to the housing or may be loose in a chamber in the pump circuit. However, it is desired that the member remain substantially in position without blocking fluid flow through the pump circuit or the chamber in which it is positioned. Thus, in one embodiment member 20 may be secured to the housing inner walls defining the inner chamber. For example, the member may be fastened directly to the housing inner walls by adhesive 50 applied at interfacing surfaces, interlock, fasteners, etc. Alternately or in addition, a retainer may be formed or positioned within the chamber to hold the member in a position away from moving out of the chamber or into a blocking position against the fluid ports. For example, in the illustrated embodiment, protrusions such as ridges 52 and spacer 54 are positioned to retain member in a spaced relation from inlet 14 and port 28, even if member 20 is or becomes loose in the reservoir chamber. In addition, or alternately, member 20 may be selected to be large enough, such as by forming as one piece and/or with consideration as to the sizes of any ports to the chamber in which it is positioned, such that it cannot pass through any ports.

As noted previously a pump according to the present inventive subject matter and its components may be of and include various forms, constructions, materials, sizes and configurations, as will be appreciated. In the illustrated embodiment, for example, housing 12 may be formed as a plurality parts and secured by fasteners 60. For example, as shown, housing may be formed in a part 62 accommodating the motor, a cap 64 defining a portion of the reservoir 24 and a mid portion 65 on either side of which the parts 62 and 64 are mounted. Such a housing arrangement provides for ease of assembly and manufacture, as the reservoir can be accessed for insertion of member 20 and motor 32 and impeller 22 can be mounted in part 62 before the housing parts are fastened together.

To facilitate use and installation, housing 12 may include mounting structures such as apertured tabs 66 for accepting mounting fasteners.

The previous description of the disclosed embodiments is provided to enable any person skilled in the art to make or use the present inventive subject matter. Various modifications to those embodiments will be readily apparent to those skilled in the art, and the generic principles defined herein may be applied to other embodiments without departing from the spirit or scope of the inventive subject matter. Thus, the present inventive subject matter is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A computer cooling system comprising:

a housing having a cap, a base member and a mid-portion positioned between and removably coupled with the cap and the base member, wherein the cap and the mid-portion define a reservoir therebetween and the cap defines a recessed inner wall in fluid communication with the reservoir;

wherein the mid-portion defines a recessed impeller chamber configured to receive a pump impeller, wherein the mid-portion further defines a retainer positioned between the impeller chamber and the reservoir;

wherein the impeller chamber and the reservoir are positioned directly adjacent to each other and fluidicly coupled with each other by a port configured to permit a liquid coolant to pass directly therebetween;

a resiliently compressible member positioned within the reservoir and configured to resiliently compress in response to a volumetric expansion of the liquid coolant;

wherein the retainer contacts the resiliently compressible member to prevent the resiliently compressible member from moving out of the reservoir or into a position blocking a liquid coolant flow through the port.

2. A computer cooling system according to claim 1, wherein the reservoir is positioned to accumulate air in the housing, to store excess liquid coolant, or both.

3. A computer cooling system according to claim 1, further comprising an impeller positioned within the impeller chamber and configured to be driven by an electrical motor.

4. A computer cooling system according to claim 1, wherein the resiliently compressible member comprises at least one piece of a closed cell sponge.

5. A computer cooling system according to claim 1, wherein the resiliently compressible member comprises a polychloroprene material.

6. A computer cooling system according to claim 1, wherein the resiliently compressible member is movable within the reservoir.

7. A computer cooling system according to claim 1, wherein the retainer comprises a unitary construction with the mid-portion of the housing.

8. A computer cooling system according to claim 1, wherein the retainer comprises a portion of housing wall positioned between the reservoir and the impeller chamber.

9. A computer cooling system according to claim 8, wherein the mid-portion of the housing defines the housing wall.

10. A computer cooling system according to claim 1, further comprising a heat exchanger fluidicly coupled with the impeller chamber and configured to reject heat absorbed by the liquid coolant from an electronic heat source.

11. A computer cooling system according to claim 1, wherein the mid portion and the cap are so removably coupled with each other as to be openable to permit access to the resiliently compressible member.

12. A computer cooling system according to claim 1, wherein the mid-portion of the housing is matingly engageable with the cap and the base member.

13. A computer cooling system according to claim 1, wherein the cap defines a recess and the recessed inner wall constitutes an inner wall of the recess, and wherein the resiliently compressible member is positioned at least partially within the recess defined by the cap.

14. A cooling system for a computer, wherein the cooling system comprises:

a housing defining an inner chamber, wherein the housing comprises a base member, a recessed cap defining a recessed inner wall in fluid communication with the inner chamber, and a mid-portion positioned between and removably coupled with the recessed cap and the base member, and wherein the inner chamber comprises a reservoir and an impeller chamber positioned directly adjacent to each other, and wherein a port extending between the reservoir and the impeller chamber is configured to permit a flow of liquid coolant directly between the reservoir and the impeller chamber;

a resiliently compressible member positioned in the reservoir and between the recessed cap and the mid-portion, wherein the resiliently compressible member is configured to resiliently compress in response to a volumetric expansion of the liquid coolant in the inner chamber;

a retainer positioned in the inner chamber between the impeller chamber and the reservoir and urging against the resiliently compressible member to prevent the resiliently compressible member from blocking a flow of liquid coolant through the port;

an impeller positioned in the impeller chamber; and a heat exchanger fluidicly coupled with the inner chamber.

15. A cooling system according to claim 14, wherein the recessed inner wall in fluid communication with inner chamber is in fluid communication with the reservoir, and wherein the resiliently compressible member extends into the recess defined by the recessed cap.

16. A cooling system according to claim 14, wherein the retainer extends transversely relative to the resiliently compressible member.

17. A cooling system according to claim 14, wherein the mid-portion of the housing defines the retainer.

18. A cooling system for a computer, wherein the cooling system comprises:

a heat exchanger and a pump;

a housing defining an impeller chamber and a reservoir, wherein the impeller chamber and the reservoir are positioned directly adjacent to each other in the housing and separated from each other by a housing wall, wherein the impeller chamber and the reservoir are fluidicly coupled with each other by a port such that a liquid coolant can flow directly between the reservoir and the impeller chamber, wherein an impeller is positioned within the impeller chamber, and wherein the housing comprises:

a base member, a recessed cap, and a mid-portion positioned between and mechanically coupled with the recessed cap and the base member, wherein the reservoir is positioned between the mid-portion and the recessed cap; and a resiliently compressible member positioned in the reservoir and configured to resiliently compress in response to a volumetric expansion of the liquid coolant, wherein a portion of the housing wall between the impeller chamber and the reservoir abuts the resiliently compressible member to prevent the resiliently compressible member from blocking a fluid flow through the port.

19. A cooling system according to claim 18, wherein the port extends through the housing wall between the reservoir and the impeller chamber.

20. A cooling system according to claim 18, wherein the recessed cap defines a first recess at least partially defining the reservoir, and wherein the mid-portion defines a second recess at least partially defining the impeller chamber.

21. A cooling system according to claim 18, wherein the portion of the housing wall that abuts the resiliently compressible member is positioned transverse relative to the resiliently compressible member.

22. A cooling system according to claim 18, wherein the portion of the housing wall that abuts the resiliently compressible member comprises a retainer.

* * * * *